US006073329A

United States Patent [19]

Lin

[11] Patent Number: 6,073,329

[45] Date of Patent: Jun. 13, 2000

[54] ASSEMBLY FIXTURE FOR USE IN CONCENTRICITY ALIGNMENT PROCEDURE OF OIL BEARING

[75] Inventor: Tung-Lung Lin, Taoyuan, Taiwan

[73] Assignee: Darfon Electronics Corp., Taoyuan, Taiwan

[21] Appl. No.: 09/220,278

[22] Filed: Dec. 23, 1998

[30] Foreign Application Priority Data

Aug. 29, 1998 [TW] Taiwan ..... 87214225

[51] Int. Cl.[7] ..... B25B 27/14

[52] U.S. Cl. ..... 29/281.5; 29/282

[58] Field of Search ..... 29/281.5, 234, 29/251, 280, 282, 263

[56] References Cited

U.S. PATENT DOCUMENTS

| | | | |
|---|---|---|---|
| 2,150,361 | 3/1939 | Chobert | 29/282 |
| 2,177,231 | 10/1939 | Tinnerman | 29/282 |
| 2,699,516 | 1/1955 | Diemer | 29/282 |
| 5,341,559 | 8/1994 | Reid et al. | 29/282 |

FOREIGN PATENT DOCUMENTS

| | | | |
|---|---|---|---|
| 477814 | 7/1975 | U.S.S.R. | 29/282 |
| 835697 | 6/1981 | U.S.S.R. | 29/282 |
| 1706833 | 1/1992 | U.S.S.R. | 29/251 |

*Primary Examiner*—David A. Scherbel
*Assistant Examiner*—Daniel G. Shanley
*Attorney, Agent, or Firm*—Majestic, Parsons, Siebert & Hsue P.C.

[57] ABSTRACT

A fixture for use in assembling a first element and a second element is provided. The first element is substantially in shaft type and the second element includes a sleeve defining an axial channel. The first element is received within the axial channel in a non-engagement condition before assembly. The assembly fixture includes a lower mold device and an upper mold device. The lower mold device is used to place the first element and the second element in a non-engagement condition before assembly. The upper mold device includes a rotatable concentricity alignment device. As the upper mode device and lower mold device are operated under a mold-press condition, the concentricity alignment device automatically performs concentricity alignment procedure of first element with regard to the sleeve of the second element and accomplishes the press fit process.

7 Claims, 4 Drawing Sheets

ASSEMBLY FIXTURE FOR USE IN CONCENTRICITY ALIGNMENT PROCEDURE OF OIL BEARING

FIELD OF INVENTION

The present invention relates to an assembly fixture and, in particular, to an assembly fixture for use in concentricity alignment procedure of oil bearing.

BACKGROUND OF INVENTION

The motor, e.g. a precision motor, in general, includes a bush (bearing) for receiving a rotor's spindle, stator windings and a base plate. The assembly procedure of the precision is stated as follows.

First, through a press machinery, the bush is pressed fit with a corresponding sleeve formed integrally on the base plate. FIG. 1 discloses the status after the bush 30 and sleeve 32 of the base plate are assembled together. Afterwards, the stator windings are formed around the sleeve. As well known in the arts, other procedures include inserting the spindle of the rotor and rotor within slot of the bush 30, etc.

The bush employed in the precision motor is type of oil bearing (bush). The oil bearing is formed by sintering powdered metal which is porous and soft. As a result, if the assembly fixture is not adequately designed, the sleeve would lose its dimension during the press fit process.

Typically, an expensive fixture with extreme precision is utilized by conventional approaches to prevent the bush from losing its design dimension.

SUMMARY OF INVENTION

To overcome the drawback of the conventional approach, the invention provides an assembly fixture of simple structure which is capable of making the concentricity alignment procedure automatically.

High accuracy is not necessary for the assembly fixture of the invention to achieve the same result the expensive fixture with extreme precision can offer.

An assembly fixture for use in assembling a first element and a second element is provided. The first element is substantially in shaft type and the second element includes a sleeve defining an axial channel. The first element is received within the axial channel in a non-engagement condition before assembly. The assembly fixture includes a lower mold and an upper mold.

The lower mold is used to place the first element and the second element in a non-engagement condition before assembly.

The upper mold includes a rotatable concentricity alignment device.

As the upper mode and lower mold are operated under a mold-press condition, the concentricity alignment device automatically performs concentricity alignment procedure of first element with regard to the sleeve and accomplishes the assembly process.

BRIEF DESCRIPTIONS OF THE DRAWINGS

FIG. 1 discloses the status in which the bush and the sleeve on the base plate is assembled together.

FIG. 2 discloses a fixture in accordance with the first embodiment.

FIG. 3(*a*) discloses the relative relationship of the bush and the fixture during the first phase of the assembly process.

FIG. 3(*b*) discloses the relative relationship of the bush and the fixture during the second phase of the assembly process.

FIG. 3(*c*) discloses the relative relationship of the bush and the fixture during the third phase of the assembly process.

FIG. 3(*d*) discloses the relative relationship of the bush and the fixture at the completion moment of the assembly process.

FIG. 4 discloses an upper mold of a fixture in accordance with the second embodiment.

DETAILED DESCRIPTION OF THE INVENTION

Figure 2:
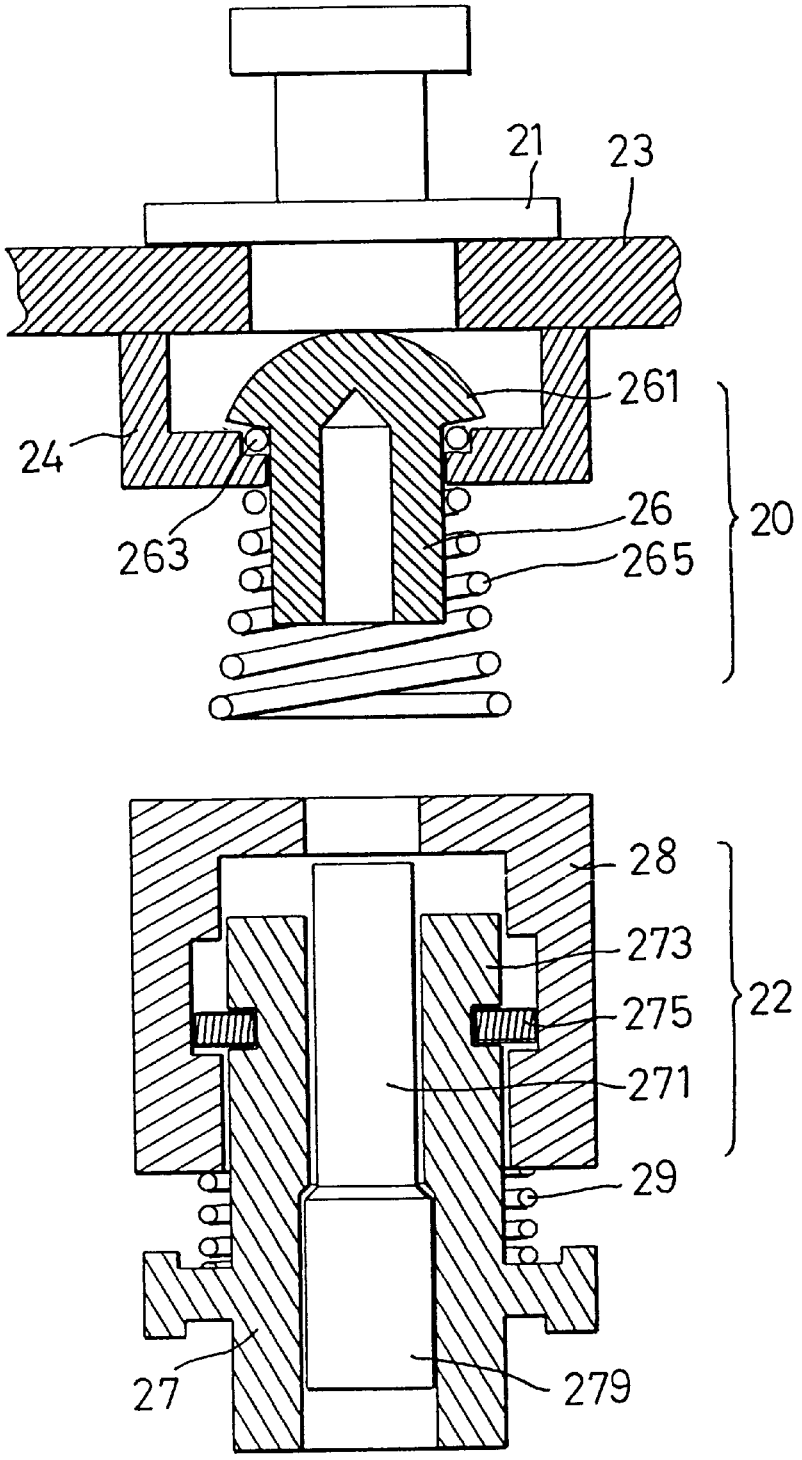
Figure 3A:
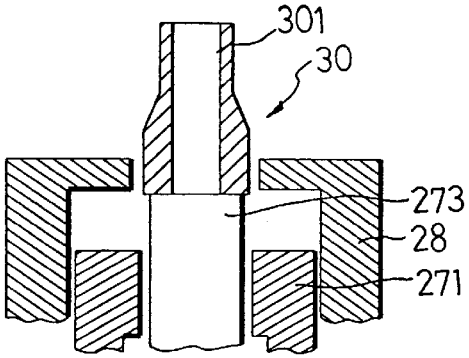
Figure 3B:
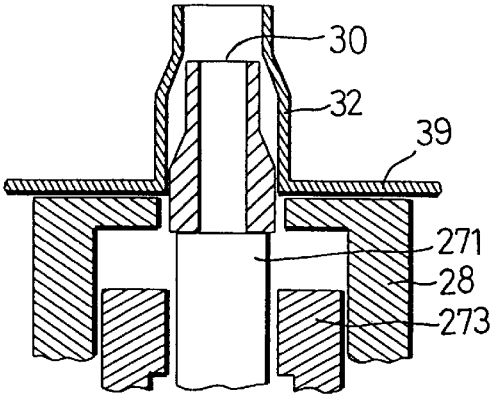
Figure 3C:
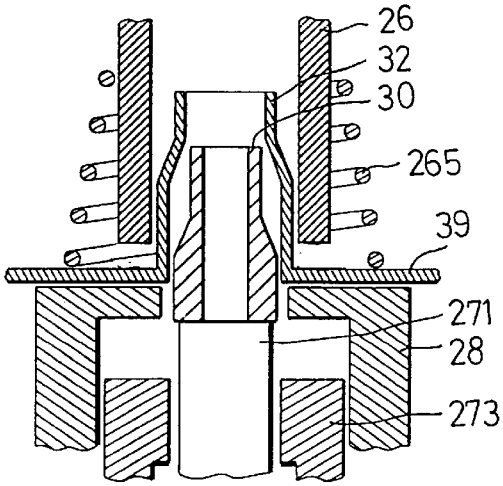
Figure 3D:
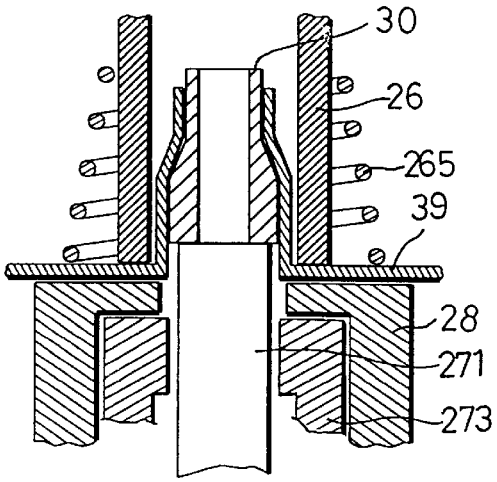

As shown in FIG. 2, the assembly fixture of the invention includes an upper mold device 20, a lower mold device 22. The upper mold 20 includes a clamping device 24 for griping a concentricity alignment device 26. The clamping device 24 is provided and attached to the die set plate 23. The power of the press machinery is transmitted to the die set 21.

The lower mold device 22 includes a slide 28. As an impact force is applied to the slide 28 from the concentricity alignment device 26, the slide 28 moves downwardly. The lower limit of the movement is the upper surface of the guide block 273. As the force from press machinery is released, due to the extension force of the spring 29, the slide 28 resumes its initial position. The upper limit of the movement is the location of stop screw 275. Besides, a height-adjustment pin 271 is provided at the center of the guide block 273 for supporting the oil bearing 30. The root of height-adjustment pin 271 may be in form of screw thread which is used to cope with inner wall of the guide block 273 such that adjustment of vertical location of the height-adjustment pin 271 is made possible. The arrangement is employed to adapt different heights of the oil bearing 30.

The concentricity alignment device 26 mainly includes a round-head type element 261, a steel ball 263 and a helical spring 265. The round-head type element 261 contacts with the corresponding wall at the clamping device 24 via large clearance, e.g. 0.5 mm, to reduce the friction. And due to the existence of the steel ball 263, a small angular rotation of the round-head type element 261 relative to the clamping device 24 is made possible. The upper end of the helical spring 265 presses against along a circumferential line of the column portion of round-head type element 261 and attaches to the column portion of round-head type element 261 by the contraction force of the helical spring 265 along the circumferential line. The round-head type element 261 is rotatable in small angle along a central axis of the circumference mentioned above. The assembly process is described as follows.

First, the oil bearing 30 is disposed within the channel at the central portion of the slide 28. At this moment, the upper portion 301 of the bush 30 is exposed to the outside of the channel of the slide 28 and the bottom surface of the bush 30 sits on the upper surface of the height-adjustment pin 271, as shown in FIG. 3(*a*).

In succession, as shown in FIG. 3(*b*), the sleeve 32 of the base plate 39 is placed to sleeve the upper portion 301 of the bush 30. At this moment, in general, the center axial line of the sleeve 32 is not coincidence with or aligned to the center axial line of the bush 30. However, due to the provision of the rotatable function of the concentricity alignment device 26 of the upper mold device 20, a concentricity alignment action is automatically achieved between the bush 30 and sleeve 32 during assembly procedure.

In other words, after the status shown in FIG. 3(*b*), the operator may then turn on the press machinery to input power to lower the die set 21 and drive the upper mold 20 downward to make a mold-press action. The mold-press action is the action by which the upper and lower mold touch against to each other and complete the require operation.

During the assembly stroke, the helical spring 265 first makes a pre-press action over the base plate 39. This pre-press action ensures the base plate 39 stays with the upper surface of the slide 28 closely as shown in FIG. 3(*c*). At this moment, the bottom of column portion of round-head type element 261 has not yet touched against the upper surface of the base plate 39. During the stroke of this phase, via the guide step provided respectively on the external surface of the bush 30 and the inner surface of the sleeve 32, a side direction force is produced. By the concentricity alignment device 26 and the rotatable capability of the helical spring 265 and the side direction force generated, the sleeve 32 and the base plate 39 can adjust the relative position to each other and complete the concentricity alignment action between the sleeve 32 and bush 30 at the end of the assembly process, as shown in FIG. 3(*d*). At this moment, the bottom of column portion of round-head type element 261 totally touches against the upper surface of the base plate 39.

Figure 1:
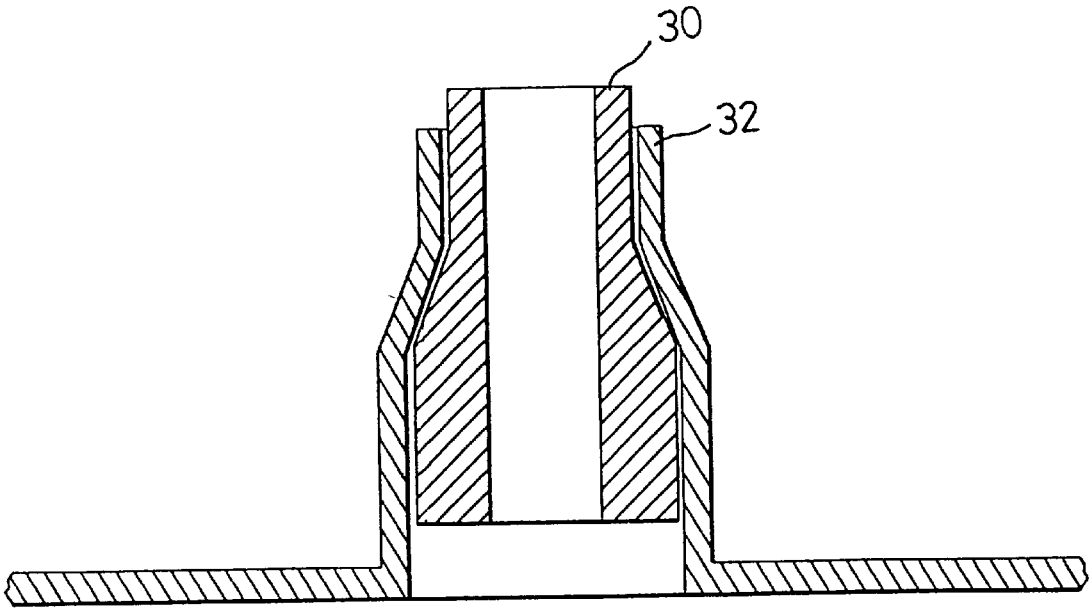

After the assembly process, the power to the press machinery is released which makes the upper mold device 20 resumes its initial position and, at the same time, the upper mold device moves away from the lower mold device 20. The bush 30 is in press fit condition with the sleeve 32 as shown FIG. 1. Afterwards, the operator takes the components in assembly form out and proceeds other well known successive operations.

Figure 4:
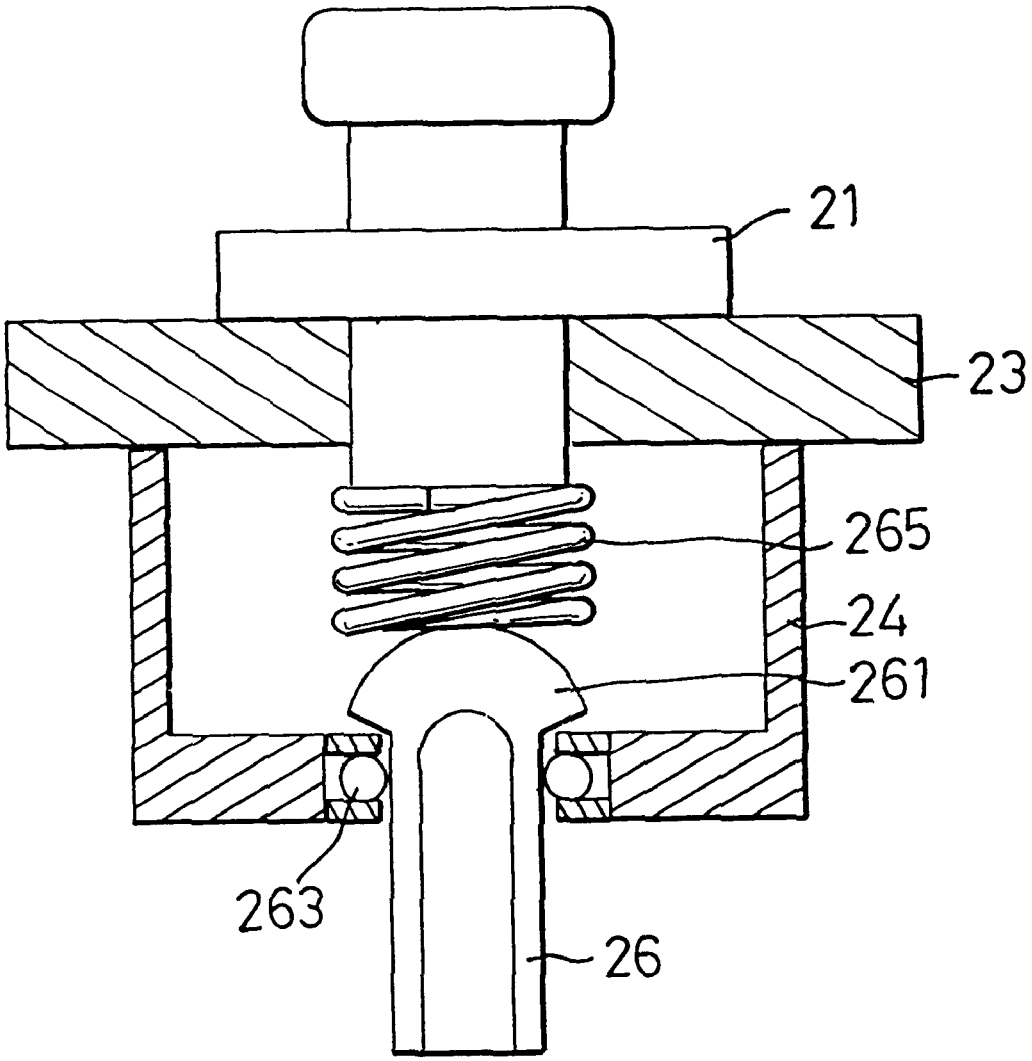

As shown in FIG. 4, the upper mold device of the second embodiment of the invention includes a clamping device 24 for griping a concentricity alignment device 26. The clamping device 24 is provided and attaches to the die set plate 23. The power to the press machinery is transmitted to the die set 21. The concentricity alignment device 26 mainly includes a round-head type element 261 and a cylindrical bar. Through the steel ball 263, relative to the clamping device 24, the concentricity alignment device 26 may displace in the horizontal direction by a small amount to proceed the concentricity alignment operation. The round-head type element 261 contacts with the corresponding wall at the clamping device 24 via large clearance, e.g. 0.5 mm, to reduce the friction. In particular, a helical spring 265 is disposed between a bottom of the die set 21 and the round-head type device 261, and one end of the helical spring 265 presses against the upper surface of the round-head type device 261. Due to the existence of the helical spring 265, the concentricity alignment device 26 is displaceable along the vertical direction. During the initial phase of the assembly process, the helical spring 265 provides a force pressing the concentricity alignment device 26 against the base plate 39 to perform the concentricity alignment operation. At the compression limit of the helical spring 265, the power to the press machinery is transferred to the die set 21, the concentricity alignment device 26 which finally acts to complete the press fit operation between the sleeve 32 and bush 30.

What is claimed is:

1. An assembly fixture for use in an assembly process for assembling a first element and a second element, the first element being substantially in shaft shaped, the second element including a sleeve defining an axial channel, the first element being received within the axial channel in a non-engagement condition before assembly, the assembly fixture comprising:

a lower mold for placing the first element and the second element in a non-engagement condition before assembly;

an upper mold, said upper mold comprising a rotatable concentricity alignment means;

wherein, as the upper mold and lower mold are operated under a mold-press condition, the concentricity alignment means aligns said first element with regard to said sleeve and accomplishes the assembly process.

2. The assembly fixture of claim 1, wherein the upper mold comprises a die set plate, a clamping device is provided on the die set plate, wherein the concentricity alignment device comprises a round-head type element which is attached to clamping device in a rotatable manner.

3. The assembly fixture of claim 2, wherein the round-head type element comprises a column portion, the concentricity alignment device further comprises a helical spring, the helical spring having an end rotatably attached to a predetermined location of the column portion.

4. The assembly fixture of claim 1, wherein the lower mold comprises:

a slidably slide, the slide comprising an open-ended channel at a central portion thereof, the first element being received within the open-ended channel of the slide;

a guide block disposed at location below the open-ended channel of the slide, the guide block being provided with a height-adjustment pin at substantially a center location thereof;

an upper portion of the first element is exposed to the external of the open-ended channel before assembly, and a bottom of the first element seats over an upper surface of the height-adjustment pin.

5. The assembly fixture of claim 1, wherein an external surface of the first element comprises a guide step.

6. The assembly fixture of claim 5, wherein an internal surface of the sleeve comprises a guide step corresponding to the guide step of the first element.

7. The assembly fixture of claim 1, wherein the upper mold comprises a die set plate and a die set, a clamping device is provided on the die set plate, wherein the concentricity alignment device comprises a round-head type element which is attached to clamping device in a displaceable manner both in vertical and horizontal direction, a helical spring is disposed between a bottom of the die set and the concentricity alignment device, one end of the helical spring presses against the upper surface of the round-head type element.

* * * * *